US008804910B1

(12) United States Patent
Wang et al.

(10) Patent No.: US 8,804,910 B1
(45) Date of Patent: Aug. 12, 2014

(54) REDUCED POWER CONSUMPTION X-RAY SOURCE

(75) Inventors: Dongbing Wang, Lathrop, CA (US); Dave Reynolds, Orem, UT (US)

(73) Assignee: Moxtek, Inc., Orem, UT (US)

( * ) Notice: Subject to any disclaimer, the term of this patent is extended or adjusted under 35 U.S.C. 154(b) by 509 days.

(21) Appl. No.: 13/307,579

(22) Filed: Nov. 30, 2011

Related U.S. Application Data

(60) Provisional application No. 61/435,545, filed on Jan. 24, 2011.

(51) Int. Cl.
*H05G 1/10* (2006.01)
*H01J 35/06* (2006.01)

(52) U.S. Cl.
USPC ..... 378/101; 378/136

(58) Field of Classification Search
CPC ..... H05G 1/10; H05G 1/32; H05G 1/06; H05G 1/54; H01J 35/06
USPC ..... 378/101, 119, 121, 136–138
See application file for complete search history.

(56) References Cited

U.S. PATENT DOCUMENTS

| | | | |
|---|---|---|---|
| 1,276,706 | A | 5/1918 | Snook et al. |
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,340,363 | A | 2/1944 | Atlee et al. |
| 2,502,070 | A | 3/1950 | Atlee et al. |
| 2,663,812 | A | 3/1950 | Jamison et al. |
| 2,683,223 | A | 7/1954 | Hosemann |
| 2,952,790 | A | 9/1960 | Steen |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

Chakrapani et al.; Capillarity-Driven Assembly of Two-Dimensional Cellular Carbon Nanotube Foams; PNAS; Mar. 23, 2004; pp. 4009-4012; vol. 101; No. 12.

(Continued)

*Primary Examiner* — Irakli Kiknadze
(74) *Attorney, Agent, or Firm* — Thorpe North & Western LLP

(57) ABSTRACT

A reduced power consumption x-ray source comprising:

In one embodiment, an x-ray tube including an infrared heat reflector disposed inside an x-ray tube cylinder between the cathode and the anode and oriented to reflect a substantial portion of infrared heat radiating from a filament back to the filament, thus reducing heat loss from the filament.

In another embodiment, an alternating current source for an x-ray tube filament including a switch for allowing power to flow to the filament for a longer or shorter time depending on the desired output x-ray flux.

In another embodiment, a neutral grounded, direct current (DC) high voltage, power supply with parallel high voltage multipliers, each supplied by separate alternating current sources, but both the output of one alternating current source connected to ground and the input of another alternating current source connected to ground. The output of both high voltage multipliers are connected.

20 Claims, 7 Drawing Sheets

(56) References Cited

U.S. PATENT DOCUMENTS 3,356,559 A 12/1967 Mohn et al.
3,397,337 A 8/1968 Denholm
3,434,062 A 3/1969 Cox
3,538,368 A 11/1970 Oess
3,665,236 A 5/1972 Gaines et al.
3,679,927 A 7/1972 Kirkendall
3,691,417 A 9/1972 Gralenski
3,741,797 A 6/1973 Chavasse, Jr. et al.
3,751,701 A 8/1973 Gralenski et al.
3,801,847 A 4/1974 Dietz
3,828,190 A 8/1974 Dahlin et al.
3,851,266 A 11/1974 Conway
3,872,287 A 3/1975 Kooman
3,882,339 A 5/1975 Rate et al.
3,894,219 A 7/1975 Weigel
3,962,583 A 6/1976 Holland et al.
3,970,884 A 7/1976 Golden
4,007,375 A 2/1977 Albert
4,075,526 A 2/1978 Grubis
4,160,311 A 7/1979 Ronde et al.
4,163,900 A 8/1979 Warren et al.
4,178,509 A 12/1979 More et al.
4,184,097 A 1/1980 Auge
4,200,795 A * 4/1980 Kawamura et al. ..... 378/106
4,250,127 A 2/1981 Warren et al.
4,293,373 A 10/1981 Greenwood
4,368,538 A 1/1983 McCorkle
4,393,127 A 7/1983 Greschner et al.
4,400,822 A 8/1983 Kuhnke et al.
4,421,986 A 12/1983 Friauf et al.
4,443,293 A 4/1984 Mallon et al.
4,463,338 A 7/1984 Utner et al.
4,504,895 A 3/1985 Steigerwald
4,521,902 A 6/1985 Peugeot
4,532,150 A 7/1985 Endo et al.
4,573,186 A 2/1986 Reinhold
4,576,679 A 3/1986 White
4,584,056 A 4/1986 Perret et al.
4,591,756 A 5/1986 Avnery
4,608,326 A 8/1986 Neukermans et al.
4,645,977 A 2/1987 Kurokawa et al.
4,675,525 A 6/1987 Amingual et al.
4,679,219 A 7/1987 Ozaki
4,688,241 A 8/1987 Peugeot
4,696,994 A 9/1987 Nakajima
4,705,540 A 11/1987 Hayes
4,734,924 A 3/1988 Yahata et al.
4,761,804 A 8/1988 Yahata
4,777,642 A 10/1988 Ono
4,797,907 A 1/1989 Anderton
4,818,806 A 4/1989 Kunimune et al.
4,819,260 A 4/1989 Haberrecker
4,862,490 A 8/1989 Karnezos et al.
4,870,671 A 9/1989 Hershyn
4,876,330 A 10/1989 Higashi et al.
4,878,866 A 11/1989 Mori et al.
4,885,055 A 12/1989 Woodbury et al.
4,891,831 A 1/1990 Tanaka et al.
4,933,557 A 6/1990 Perkins
4,939,763 A 7/1990 Pinneo et al.
4,957,773 A 9/1990 Spencer et al.
4,960,486 A 10/1990 Perkins et al.
4,969,173 A 11/1990 Valkonet
4,979,198 A 12/1990 Malcolm et al.
4,979,199 A 12/1990 Cueman et al.
4,995,069 A 2/1991 Tanaka
5,010,562 A 4/1991 Hernandez et al.
5,060,252 A * 10/1991 Vogler et al. ..... 378/93
5,063,324 A 11/1991 Grunwald
5,066,300 A 11/1991 Isaacson et al.
5,077,771 A 12/1991 Skillicorn et al.
5,077,777 A 12/1991 Daly
5,090,046 A 2/1992 Friel
5,105,456 A 4/1992 Rand et al.
5,117,829 A 6/1992 Miller et al.
5,153,900 A 10/1992 Nomikos et al.
5,161,179 A 11/1992 Suzuki et al.
5,173,612 A 12/1992 Imai et al.
5,178,140 A 1/1993 Ibrahim
5,187,737 A 2/1993 Watanabe
5,196,283 A 3/1993 Ikeda et al.
5,200,984 A 4/1993 Laeuffer
5,217,817 A 6/1993 Verspui et al.
5,226,067 A 7/1993 Allred et al.
RE34,421 E 10/1993 Parker et al.
5,258,091 A 11/1993 Imai et al.
5,267,294 A 11/1993 Kuroda et al.
5,302,523 A 4/1994 Coffee et al.
5,343,112 A 8/1994 Wegmann
5,347,571 A 9/1994 Furbee et al.
5,391,958 A 2/1995 Kelly
5,392,042 A 2/1995 Pellon
5,400,385 A 3/1995 Blake et al.
5,422,926 A 6/1995 Smith et al.
5,428,658 A 6/1995 Oettinger et al.
5,432,003 A 7/1995 Plano et al.
5,469,429 A 11/1995 Yamazaki et al.
5,469,490 A 11/1995 Golden et al.
5,478,266 A 12/1995 Kelly
5,521,851 A 5/1996 Wei et al.
5,524,133 A 6/1996 Neale et al.
RE35,383 E 11/1996 Miller et al.
5,571,616 A 11/1996 Phillips et al.
5,578,360 A 11/1996 Viitanen
5,602,507 A 2/1997 Suzuki
5,607,723 A 3/1997 Plano et al.
5,621,780 A 4/1997 Smith et al.
5,627,871 A 5/1997 Wang
5,631,943 A 5/1997 Miles
5,673,044 A 9/1997 Pellon
5,680,433 A 10/1997 Jensen
5,682,412 A 10/1997 Skillicorn et al.
5,696,808 A 12/1997 Lenz
5,706,354 A 1/1998 Stroehlein
5,729,583 A 3/1998 Tang et al.
5,774,522 A 6/1998 Warburton
5,812,632 A 9/1998 Schardt et al.
5,835,561 A 11/1998 Moorman et al.
5,870,051 A 2/1999 Warburton
5,898,754 A 4/1999 Gorzen
5,907,595 A 5/1999 Sommerer
5,978,446 A 11/1999 Resnick
6,002,202 A 12/1999 Meyer et al.
6,005,918 A 12/1999 Harris et al.
6,044,130 A 3/2000 Inazura et al.
6,062,931 A 5/2000 Chuang et al.
6,063,629 A 5/2000 Knoblauch
6,069,278 A 5/2000 Chuang
6,073,484 A 6/2000 Miller et al.
6,075,839 A 6/2000 Treseder
6,097,790 A 8/2000 Hasegawa et al.
6,129,901 A 10/2000 Moskovits et al.
6,133,401 A 10/2000 Jensen
6,134,300 A 10/2000 Trebes et al.
6,184,333 B1 2/2001 Gray
6,205,200 B1 3/2001 Boyer et al.
6,277,318 B1 8/2001 Bower et al.
6,282,263 B1 8/2001 Arndt et al.
6,288,209 B1 9/2001 Jensen
6,307,008 B1 10/2001 Lee et al.
6,320,019 B1 11/2001 Lee et al.
6,351,520 B1 2/2002 Inazaru
6,385,294 B2 5/2002 Suzuki et al.
6,388,359 B1 5/2002 Duelli et al.
6,438,207 B1 8/2002 Chidester et al.
6,477,235 B2 11/2002 Chornenky et al.
6,487,272 B1 11/2002 Kutsuzawa
6,487,273 B1 11/2002 Takenaka et al.
6,494,618 B1 12/2002 Moulton
6,546,077 B2 4/2003 Chornenky et al.
6,567,500 B2 5/2003 Rother
6,645,757 B1 11/2003 Okandan et al.
6,646,366 B2 11/2003 Hell et al.
6,658,085 B2 12/2003 Sklebitz et al.

(56) References Cited

U.S. PATENT DOCUMENTS

| | | | |
|---|---|---|---|
| 6,661,876 | B2 | 12/2003 | Turner et al. |
| 6,740,874 | B2 | 5/2004 | Doring |
| 6,778,633 | B1 | 8/2004 | Loxley et al. |
| 6,799,075 | B1 | 9/2004 | Chornenky et al. |
| 6,803,570 | B1 | 10/2004 | Bryson, III et al. |
| 6,816,573 | B2 | 11/2004 | Hirano et al. |
| 6,819,741 | B2 | 11/2004 | Chidester |
| 6,838,297 | B2 | 1/2005 | Iwasaki |
| 6,852,365 | B2 | 2/2005 | Smart et al. |
| 6,866,801 | B1 | 3/2005 | Mau et al. |
| 6,876,724 | B2 | 4/2005 | Zhou |
| 6,900,580 | B2 | 5/2005 | Dai et al. |
| 6,956,706 | B2 | 10/2005 | Brandon |
| 6,962,782 | B1 | 11/2005 | Livache et al. |
| 6,976,953 | B1 | 12/2005 | Pelc |
| 6,987,835 | B2 | 1/2006 | Lovoi |
| 7,035,379 | B2 | 4/2006 | Turner et al. |
| 7,046,767 | B2 | 5/2006 | Okada et al. |
| 7,049,735 | B2 | 5/2006 | Ohkubo et al. |
| 7,050,539 | B2 | 5/2006 | Loef et al. |
| 7,075,699 | B2 | 7/2006 | Oldham et al. |
| 7,085,354 | B2 | 8/2006 | Kanagami |
| 7,108,841 | B2 | 9/2006 | Smalley |
| 7,110,498 | B2 | 9/2006 | Yamada |
| 7,130,380 | B2 | 10/2006 | Lovoi et al. |
| 7,130,381 | B2 | 10/2006 | Lovoi et al. |
| 7,189,430 | B2 | 3/2007 | Ajayan et al. |
| 7,203,283 | B1 | 4/2007 | Puusaari |
| 7,206,381 | B2 | 4/2007 | Shimono et al. |
| 7,215,741 | B2 | 5/2007 | Ukita |
| 7,224,769 | B2 | 5/2007 | Turner |
| 7,233,071 | B2 | 6/2007 | Furukawa et al. |
| 7,233,647 | B2 | 6/2007 | Turner et al. |
| 7,286,642 | B2 | 10/2007 | Ishikawa et al. |
| 7,305,066 | B2 | 12/2007 | Ukita |
| 7,317,784 | B2 | 1/2008 | Durst et al. |
| 7,358,593 | B2 | 4/2008 | Smith et al. |
| 7,382,862 | B2 | 6/2008 | Bard et al. |
| 7,399,794 | B2 | 7/2008 | Harmon et al. |
| 7,410,603 | B2 | 8/2008 | Noguchi et al. |
| 7,428,298 | B2 | 9/2008 | Bard et al. |
| 7,448,801 | B2 | 11/2008 | Oettinger et al. |
| 7,448,802 | B2 | 11/2008 | Oettinger et al. |
| 7,486,774 | B2 | 2/2009 | Cain |
| 7,526,068 | B2 | 4/2009 | Dinsmore |
| 7,529,345 | B2 | 5/2009 | Bard et al. |
| 7,618,906 | B2 | 11/2009 | Meilahti |
| 7,634,052 | B2 | 12/2009 | Grodzins et al. |
| 7,649,980 | B2 | 1/2010 | Aoki et al. |
| 7,650,050 | B2 | 1/2010 | Haffner et al. |
| 7,657,002 | B2 | 2/2010 | Burke et al. |
| 7,675,444 | B1 | 3/2010 | Smith et al. |
| 7,680,652 | B2 | 3/2010 | Giesbrecht et al. |
| 7,693,265 | B2 | 4/2010 | Hauttmann et al. |
| 7,709,820 | B2 | 5/2010 | Decker et al. |
| 7,737,424 | B2 | 6/2010 | Xu et al. |
| 7,756,251 | B2 | 7/2010 | Davis et al. |
| 2002/0075999 | A1 | 6/2002 | Rother |
| 2002/0094064 | A1 | 7/2002 | Zhou |
| 2003/0096104 | A1 | 5/2003 | Tobita et al. |
| 2003/0152700 | A1 | 8/2003 | Asmussen et al. |
| 2003/0165418 | A1 | 9/2003 | Ajayan et al. |
| 2004/0076260 | A1 | 4/2004 | Charles, Jr. et al. |
| 2004/0192997 | A1* | 9/2004 | Lovoi ..... 600/3 |
| 2005/0018817 | A1 | 1/2005 | Oettinger et al. |
| 2005/0141669 | A1 | 6/2005 | Shimono et al. |
| 2005/0207537 | A1 | 9/2005 | Ukita |
| 2006/0073682 | A1 | 4/2006 | Furukawa et al. |
| 2006/0098778 | A1 | 5/2006 | Oettinger et al. |
| 2006/0210020 | A1 | 9/2006 | Takahashi et al. |
| 2006/0233307 | A1 | 10/2006 | Dinsmore |
| 2006/0269048 | A1 | 11/2006 | Cain |
| 2006/0280289 | A1 | 12/2006 | Hanington et al. |
| 2007/0025516 | A1 | 2/2007 | Bard et al. |
| 2007/0087436 | A1 | 4/2007 | Miyawaki et al. |
| 2007/0111617 | A1 | 5/2007 | Meilahti |
| 2007/0133921 | A1 | 6/2007 | Haffner et al. |
| 2007/0142781 | A1 | 6/2007 | Sayre |
| 2007/0165780 | A1 | 7/2007 | Durst et al. |
| 2007/0172104 | A1 | 7/2007 | Nishide |
| 2007/0176319 | A1 | 8/2007 | Thostenson et al. |
| 2007/0183576 | A1 | 8/2007 | Burke et al. |
| 2007/0217574 | A1 | 9/2007 | Beyerlein |
| 2008/0199399 | A1 | 8/2008 | Chen et al. |
| 2008/0296479 | A1 | 12/2008 | Anderson et al. |
| 2008/0296518 | A1 | 12/2008 | Xu et al. |
| 2008/0317982 | A1 | 12/2008 | Hecht |
| 2009/0085426 | A1 | 4/2009 | Davis et al. |
| 2009/0086923 | A1 | 4/2009 | Davis et al. |
| 2009/0213914 | A1 | 8/2009 | Dong et al. |
| 2009/0243028 | A1 | 10/2009 | Dong et al. |
| 2010/0096595 | A1 | 4/2010 | Prud'Homme et al. |
| 2010/0098216 | A1 | 4/2010 | Dobson |
| 2010/0126660 | A1 | 5/2010 | O'Hara |
| 2010/0140497 | A1 | 6/2010 | Damiano, Jr. et al. |
| 2010/0189225 | A1 | 7/2010 | Ernest et al. |
| 2010/0239828 | A1 | 9/2010 | Cronaby et al. |
| 2010/0243895 | A1 | 9/2010 | Xu et al. |
| 2010/0248343 | A1 | 9/2010 | Aten et al. |
| 2010/0285271 | A1 | 11/2010 | Davis et al. |
| 2010/0323419 | A1 | 12/2010 | Aten et al. |
| 2011/0017921 | A1 | 1/2011 | Jiang et al. |
| 2011/0022446 | A1* | 1/2011 | Carney et al. ..... 705/14.1 |

FOREIGN PATENT DOCUMENTS

| | | |
|---|---|---|
| DE | 19818057 | 11/1999 |
| EP | 0297808 | 1/1989 |
| EP | 0330456 | 8/1989 |
| EP | 0400655 | 5/1990 |
| EP | 0676772 | 3/1995 |
| GB | 1252290 | 11/1971 |
| JP | 57 082954 | 8/1982 |
| JP | 3170673 | 7/1991 |
| JP | 4171700 | 6/1992 |
| JP | 05066300 | 3/1993 |
| JP | 5066300 | 3/1993 |
| JP | 5135722 | 6/1993 |
| JP | 06119893 | 7/1994 |
| JP | 6289145 | 10/1994 |
| JP | 6343478 | 12/1994 |
| JP | 8315783 | 11/1996 |
| JP | 08315783 | 11/1996 |
| JP | 2003/007237 | 1/2003 |
| JP | 2003/088383 | 3/2003 |
| JP | 2003510236 | 3/2003 |
| JP | 2003211396 | 7/2003 |
| JP | 2006297549 | 11/2006 |
| KR | 1020050107094 | 11/2005 |
| WO | WO 99/65821 | 12/1999 |
| WO | WO 00/09443 | 2/2000 |
| WO | WO 00/17102 | 3/2000 |
| WO | WO 03/076951 | 9/2003 |
| WO | WO2008/052002 | 5/2008 |
| WO | WO 2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |

OTHER PUBLICATIONS

Chen, Xiaohua et al., "Carbon-nanotube metal-matrix composites prepared by electroless plating," Composites Science and Technology, 2000, pp. 301-306, vol. 60.

Coleman, et al.; "Mechanical Reinforcement of Polymers Using Carbon Nanotubes"; Adv. Mater. 2006, 18, 689-706.

Coleman, et al.; "Small but strong: A review of the mechanical properties of carbon nanotube-polymer composites"; Carbon 44 (2006) 1624-1652.

Flahaut, E. et al, "Carbon Nanotube-metal-oxide nanocomposites; microstructure, electrical conductivity and mechanical properties," Acta mater., 2000, pp. 3803-3812.Vo. 48.

(56) References Cited

OTHER PUBLICATIONS

Gevin et al., "IDeF-X V1.0: performances of a new CMOS multi channel analogue readout ASIC for Cd(Zn)Te detectors", IDDD, Oct. 2005, 433-437, vol. 1.
Grybos et al., "DEDIX—development of fully integrated multichannel ASCI for high count rate digital x-ray imaging systems", IEEE, 693-696, vol. 2.
Grybos et al., "Measurements of matching and high count rate performance of mulitchannel ASIC for digital x-ray imaging systems", IEEE, Aug. 2007, 1207-1215, vol. 54, Issue 4.
Grybos et al., "Pole-Zero cancellation circuit with pulse pile-up tracking system for low noise charge-sensitive amplifiers", Feb. 2008, 583-590, vol. 55, Issue 1.
Hexcel Corporation; "Prepreg Technology" brochure; http://www.hexcel.com/Reso2882urces/DataSheets/Brochure-Data-Sheets/Prepreg_Technology.pdf.
http://www.orau.org/ptp/collectio/xraytubescollidge/MachlettCW250T.htm, 1999, 2 pages.
Hu, et al.; "Carbon Nanotube Thin Films: Fabrication, Properties, and Applications"; 2010 American Chemical Society Jul. 22, 2010.
Hutchison, "Vertically aligned carbon nanotubes as a framework for microfabrication of high aspect ration mems," 2008, pp. 1-50.
Jiang, Linquin et al., "Carbon nanotubes-metal nitride composites; a new class of nanocomposites with enhanced electrical properties," J. Mater. Chem., 2005, pp. 260-266, vol. 15.
Li, Jun et al., "Bottom-up approach for carbon nanotube interconnects," Applied Physics Letters, Apr. 14, 2003, pp. 2491-2493, vol. 82 No. 15.
Ma. R.Z., et al., "Processing and properties of carbon nanotubes-nano-SIC ceramic", Journal of Materials Science 1998, pp. 5243-5246, vol. 33.
Micro X-ray Tube Operation Manual, X-ray and Specialty Instruments Inc., 1996, 5 pages.
Moore, A. W., S. L. Strong, and G. L. Doll, "Properties and characterization of codeposited boron nitride and carbon materials," J. Appl. Phys. 65, 5109 (1989).
Najafi, et al.; "Radiation resistant polymer-carbon nanotube nanocomposite thin films"; Department of Materials Science and Engineering . . . Nov. 21, 2004.
Nakajima et al; Trial Use of Carbon-Fiber-Reinforced Plastic as a Non-Bragg Window Material of X-Ray Transmission; Rev. Sci. Instrum.; Jul. 1989; pp. 2432-2435; vol. 60, No. 7.
Nakamura, K., "Preparation and properties of amorphous boron nitride films by molecular flow chemical vapor deposition," J. Electrochem. Soc. 132, 1757 (1985).
Neyco, "SEM & TEM: Grids"; catalog; http://www.neyco.fr/pdf/Grids.pdf#page=1.
Panayiotatos, et al., "Mechanical performance and growth characteristics of boron nitride films with respect to their optical, compositional properties and density," Surface and Coatings Technology, 151-152 (2002) 155-159.
Peigney, et al., "Carbon nanotubes in novel ceramic matrix nanocomposites," Ceramics International, 2000, pp. 677-683, vol. 26.
Perkins, F. K., R. A. Rosenberg, and L. Sunwoo, "Synchrotronradiation deposition of boron and boron carbide films from boranes and carboranes: decaborane," J. Appl. Phys. 69,4103 (1991).
Powell et al., "Metalized polyimide filters for x-ray astronomy and other applications," SPIE, pp. 432-440, vol. 3113.
Rankov et al., "A novel correlated double sampling poly-Si circuit for readout systems in large area x-ray sensors", IEEE, May 2005, 728-731, vol. 1.
Roca i Cabarrocas, P., S. Kumar, and B. Drevillon, "In situ study of the thermal decomposition of B.sub.2 H.sub.6 by combining spectroscopic ellipsometry and Kelvin probe measurements," J. Appl. Phys. 66, 3286 (1989).
Satishkumar B.C., et al. "Synthesis of metal oxide nanorods using carbon nanotubes as templates," Journal of Materials Chemistry, 2000, pp. 2115-2119, vol. 10.
Scholze et al., "Detection efficiency of energy-dispersive detectors with low-energy windows" X-Ray Spectrometry, X-Ray Spectrom, 2005: 34: 473-476.
Sheather, "The support of thin windows for x-ray proportional counters," Journal Phys,E., Apr. 1973, pp. 319-322, vol. 6, No. 4.
Shirai, K., S.-I. Gonda, and S. Gonda, "Characterization of hydrogenated amorphous boron films prepared by electron cyclotron resonance plasma chemical vapor deposition method," J. Appl. Phys. 67, 6286 (1990).
Tamura, et al "Developmenmt of ASICs for CdTe Pixel and Line Sensors", IEEE Transactions on Nuclear Science, vol. 52, No. 5, Oct. 2005.
Tien-Hui Lin et al., "An investigation on the films used as the windows of ultra-soft X-ray counters." Acta Physica Sinica, vol. 27, No. 3, pp. 276-283, May 1978, abstract only.
U.S. Appl. No. 12/640,154, filed Dec. 17, 2009; Krzysztof Kozaczek.
U.S. Appl. No. 12/726,120, filed Mar. 17, 2010; Michael Lines.
U.S. Appl. No. 12/783,707, filed May 20, 2010; Steven D. Liddiard.
U.S. Appl. No. 12/899,750, filed Oct. 7, 2010; Steven Liddiard.
U.S. Appl. No. 13/018,667, filed Feb. 1, 2011; Robert C. Davis.
U.S. Appl. No. 13/018,667, filed Feb. 1, 2011; Lei Pei.
U.S. Appl. No. 13/307,559, filed Nov. 30, 2011; Dongbing Wang.
Vajtai et al.; Building Carbon Nanotubes and Their Smart Architectures; Smart Mater. Struct.; 2002; vol. 11; pp. 691-698.
Vandenbulcke, L. G., "Theoretical and experimental studies on the chemical vapor deposition of boron carbide," Indust. Eng. Chem. Prod. Res. Dev. 24, 568 (1985).
Viitanen Veli-Pekka et al., Comparison of Ultrathin X-Ray Window Designs, presented at the Soft X-rays in the 21st Century Conference held in Provo, Utah Feb. 10-13, 1993, pp. 182-190.
Wagner et al, "Effects of Scatter in Dual-Energy Imaging: An Alternative Analysis"; IEEE; Sep. 1989, vol. 8. No. 3.
Wang, et al.; "Highly oriented carbon nanotube papers made of aligned carbon nanotubes"; Tsinghua-Foxconn Nanotechnology Research Center and Department of Physics; Published Jan. 31, 2008.
Winter, J., H. G. Esser, and H. Reimer, "Diborane-free boronization," Fusion Technol. 20, 225 (1991).
Wu, et al.; "Mechanical properties and thermo-gravimetric analysis of PBO thin films"; Advanced Materials Laboratory, Institute of Electro-Optical Engineering; Apr. 30, 2006.
www.moxtek,com, Moxtek, Sealed Proportional Counter X-Ray Windows, Oct. 2007, 3 pages.
www.moxtek.com, Moxtek, AP3 Windows, Ultra-thin Polymer X-Ray Windows, Sep. 2006, 2 pages.
www.moxtek.com, Moxtek, DuraBeryllium X-Ray Windows, May 2007, 2 pages.
www.moxtek.com, Moxtek, ProLine Series 10 Windows, Ultra-thin Polymer X-Ray Windows, Sep. 2006, 2 pages.
www.moxtek.com, X-Ray Windows, ProLINE Series 20 Windows Ultra-thin Polymer X-ray Windows, 2 pages. Applicant believes that this product was offered for sale prior to the filed of applicant's application.
Xie, et al.; "Dispersion and alignment of carbon nanotubes in polymer matrix: A review"; Center for Advanced Materials Technology; Apr. 20, 2005.
Yan, Xing-Bin, et al., Fabrications of Three-Dimensional ZnO-Carbon Nanotube (CNT) Hybrids Using Self-Assembled CNT Micropatterns as Framework, 2007. pp. 17254-17259, vol. III.
Zhang, et al.; "Superaligned Carbon Nanotube Grid for High Resolution Transmission Electron Microscopy of Nanomaterials"; 2008 American Chemical Society.
Anderson et al., U.S. Appl. No. 11/756,962, filed Jun. 1, 2007.
Barkan et al., "Improved window for low-energy x-ray transmission a Hybrid design for energy-dispersive microanalysis," Sep. 1995, 2 pages, Ectroscopy 10(7).
Blanquart et al.; "XPAD, a New Read-out Pixel Chip for X-ray Counting"; IEEE Xplore; Mar. 25, 2009.
Comfort, J. H., "Plasma-enhanced chemical vapor deposition of in situ doped epitaxial silicon at low temperatures," J. Appl. Phys. 65, 1067 (1989).
Das, D. K., and K. Kumar, "Chemical vapor deposition of boron on a beryllium surface," Thin Solid Films, 83(1), 53-60.

(56) References Cited

OTHER PUBLICATIONS

Das, K., and Kumar, K., "Tribological behavior of improved chemically vapor-deposited boron on beryllium," Thin Solid Films, 108(2), 181-188.
Hanigofsky, J. A., K. L. More, and W. J. Lackey, "Composition and microstructure of chemically vapor-deposited boron nitride, aluminum nitride, and boron nitride + aluminum nitride composites," J. Amer. Ceramic Soc. 74, 301 (1991).
Komatsu, S., and Y. Moriyoshi, "Influence of atomic hydrogen on the growth reactions of amorphous boron films in a low-pressure B.sub.2 H.sub.6 +He+H.sub.2 plasma", J. Appl. Phys. 64, 1878 (1988).
Komatsu, S., and Y. Moriyoshi, "Transition from amorphous to crystal growth of boron films in plasma-enhanced chemical vapor deposition with B.sub.2 H.sub.6 +He," J. Appl. Phys., 66, 466 (1989).
Komatsu, S., and Y. Moriyoshi, "Transition from thermal-to electron-impact decomposition of diborane in plasma-enhanced chemical vapor deposition of boron films from B.sub.2 H.sub.6 +He," J. Appl. Phys. 66, 1180 (1989).
Lee, W., W. J. Lackey, and P. K. Agrawal, "Kinetic analysis of chemical vapor deposition of boron nitride," J. Amer. Ceramic Soc. 74, 2642 (1991).
Lines, U.S. Appl. No. 12/352,864, filed Jan. 13, 2009.
Lines, U.S. Appl. No. 12/726,120, filed Mar. 17, 2010.
Maya, L., and L. A. Harris, "Pyrolytic deposition of carbon films containing nitrogen and/or boron," J. Amer. Ceramic Soc. 73, 1912 (1990).
Michaelidis, M., and R. Pollard, "Analysis of chemical vapor deposition of boron," J. Electrochem. Soc. 132, 1757 (1985).
PCT Application PCT/US2011/044168; filing date Jul. 15, 2011; Dongbing Wang; International Search Report mailed Mar. 28, 2012.
U.S. Appl. No. 12/899,750, filed Oct. 7, 2010; Steven Liddiard; notice of allowance dated Jun. 4, 2013.
U.S. Appl. No. 12/890,325, filed Sep. 24, 2010; Dongbing Wang; notice of allowance dated Jul. 16, 2013.
U.S. Appl. No. 12/890,325, filed Sep. 24, 2010; Dongbing Wang; office action dated Sep. 7, 2012.

* cited by examiner

REDUCED POWER CONSUMPTION X-RAY SOURCE

CLAIM OF PRIORITY

Priority is claimed to U.S. Provisional Patent Application Ser. No. 61/435,545, filed Jan. 24, 2011, and is hereby incorporated herein by reference in its entirety.

BACKGROUND

1. Field of the Invention

The present invention relates generally to x-ray tubes and power supplies for x-ray tubes.

2. Related Art

A desirable characteristic of x-ray sources, especially portable x-ray sources, is reduced power consumption, thus allowing for longer battery life. Another desirable characteristic of x-ray sources is power supply electronic stability.

Power Loss Due to Filament Heat Loss

One component of x-ray sources that requires power input is an x-ray tube filament, located at an x-ray tube cathode. Alternating current through the filament can heat the filament to very high temperatures, such as around 1000-3000° C. The high temperature of the filament, combined with a large voltage differential between the x-ray tube cathode and anode can result in electrons propelled from the filament to the anode.

Some of the heat at the filament can be lost to surrounding components through conduction and radiation heat transfer. Electric power input to the filament is required to compensate for this heat loss and keep the filament at the required high temperature. This electric power input to compensate for heat loss results in wasted power and, for x-ray sources that use batteries, decreased battery life.

The wasted heat can be transferred to electronic components in the power supply, resulting in temperature fluctuations in these electronic components. These temperature fluctuations can cause instability in the power supply because of the temperature dependency of many electronic components.

Power Loss Due to Linear Regulator

Another component of x-ray sources that can cause power loss in x-ray sources is a linear regulator in an alternating current source for an x-ray tube filament. FIG. 7 will be used in the following discussion regarding use of a linear regulator 72 in an alternating current source 70 for an x-ray tube filament.

Voltage source 401 can provide direct current (DC) to a direct current to alternating current (DC to AC) converter 403. Voltage source 401 can be a constant voltage power supply. X-ray tube 405 is shown comprising a filament 406, cathode 407, evacuated cylinder 408, and anode 409. The DC to AC converter 403 can provide alternating current to x-ray tube filament 406. A transformer 404 may separate the DC to AC converter 403, at low DC bias voltage, from the filament 406, at high DC bias voltage, thus an AC signal can be passed from a low DC bias to a high DC bias. Due to heat caused by alternating current through the filament 406, and due to a large DC voltage differential between the filament 406 and the anode 409, an electron beam 410 may be generated from the filament 406 to the anode 409. Electrons from this electron beam 410 impinge upon the anode, thus producing x-rays 417.

There is often a need to change the flux of x-rays 417 exiting the x-ray tube 405. Adjusting alternating current flow through the filament 406 can change the electron beam 410 flux and thus the x-ray 417 flux. A linear regulator 72 can be used to adjust alternating current flow through the filament 406.

Electron beam 410 flux and thus x-ray 417 flux can be approximated by an amount of electrical current flowing from a high voltage multiplier 411 through feedback module 414 to a filament circuit 412. The feedback module 414 can determine the current flow, such as by measuring voltage drop across a resistor. The feedback module 414 can receive input 416, such as from an operator of the x-ray source, of a desired x-ray 417 flux. The feedback module 414 can then send a signal 415 to the linear regulator 72 to change the amount of current to the DC to AC converter 403 based on the input 416 and the x-ray 417 flux.

For example, input 416 can be reduced for a desired reduction in x-ray 417 flux. Feedback module 414 can detect that x-ray 417 flux is too high due to too large of a current through the feedback module for the new, lower input 416. A signal 415 can be sent to the linear regulator 72 to increase voltage drop across the linear regulator 72, thus allowing a lower DC voltage to reach the DC to AC converter 403. The DC to AC converter 403 can then provide less alternating current to the filament 406 resulting in lower filament 406 temperature, lower electron beam 410 flux and lower x-ray 417 flux.

The larger voltage drop across the linear regulator 72 at low x-ray 417 flux levels can result in wasted power because the power input from the voltage source 401 can be the same at low x-ray 417 flux as at high x-ray 417 flux. Another problem with this design is that the wasted heat, due to larger voltage drop across the linear regulator 72 at low x-ray 417 flux, can heat surrounding electronic components, resulting in temperature fluctuations and instability in these electronic components.

High Voltage Multiplier Distributed Capacitance Power Loss

As shown in FIG. 8, a high direct current (DC) voltage generator 80, comprising an alternating current (AC) source 51 and high voltage multiplier 54 can have a power loss, shown as imaginary distributed capacitor 81. This capacitance, between an AC connection **54*b* and ground connection 54*a* can be large and can result in power loss as alternating current flows to and from the ground 53. It could be beneficial if the alternating current did not flow to and from the ground 53, or if alternating current to and from the ground 53 was substantially reduced, thus avoiding or reducing the large capacitive power loss between the high voltage multiplier 54 and ground 53**. This power loss is wasted energy and can result in reduced battery life, for battery powered power supplies.

SUMMARY

It has been recognized that it would be advantageous to create an x-ray source with reduced power consumption, such as by reducing (1) heat loss from the x-ray tube filament, (2) power lost in regulating power flow to the DC to AC converter, and/or (3) distributed capacitance power loss between a high voltage multiplier and ground. It has been recognized that it would be advantageous to create an x-ray source with improved power supply electronic stability, such as by reducing heat transfer, from wasted heat, to the power supply electronics. The present invention is directed to an x-ray source that satisfies the need for reduced power consumption and/or improved electronic stability.

In one embodiment, the x-ray tube comprises an evacuated insulative cylinder with an anode disposed at one end and a cathode disposed at an opposing end. The anode includes a material configured to produce x-rays in response to impact of electrons. The cathode includes a filament disposed at an inward face of the cathode. The filament is configured to produce electrons accelerated towards the anode in response to an electric field between the anode and the cathode. An infrared heat reflector is disposed inside the insulative cylinder between the cathode and the anode and oriented to reflect a substantial portion of infrared heat radiating from the filament back to the filament, thus reducing heat loss from the filament. The reflector has a curved, concave shape facing the cathode. The reflector has an opening aligned with an electron path between the filament and the anode and the opening is sized to allow a substantial amount of electrons to flow from the filament to the anode. Reduced heat loss results in reduce wasted power consumption and reduced heating of surrounding electronic components.

In another embodiment, an alternating current source for an x-ray tube filament comprises a voltage source, a switch that is electrically coupled to the voltage source, the switch having a first switch position in which electrical current is allowed to flow through the switch to a DC to AC converter and a second switch position in which electrical current is not allowed to flow through the switch. The DC to AC converter provides alternating current to the x-ray tube filament when the switch is in the first position. A feedback module receives input regarding an electron beam current level from the filament and directs the switch to the first switch position for more or less time based on the electron beam current level. Thus, electrical current is not allowed to flow through the switch for more time for lower power settings, rather than converting excess power into heat, as is the case with linear regulators.

In another embodiment, capacitive power loss between a high voltage multiplier and ground may be reduced with a neutral grounded, direct current (DC) high voltage, power supply. The power supply comprises (1) a first alternating current (AC) source having a first connection and a second connection; (2) a second AC source having a first connection and a second connection; (3) a first high voltage multiplier having an AC connection, a ground connection, and an output connection; and (4) a second high voltage multiplier having an AC connection, a ground connection, and an output connection. The first connection of the first AC source is electrically connected to (1) the second connection of the second AC source; (2) an electrical ground; (3) the first high voltage multiplier ground connection; and (4) the second high voltage multiplier ground connection. The second connection of the first AC source is electrically connected to the first high voltage multiplier AC connection. The first connection of the second AC source is electrically connected to the second high voltage multiplier AC connection. The first high voltage multiplier output connection is electrically connected to the second high voltage multiplier output connection. With this design, the amount of current flowing to ground can be reduced, thus minimizing capacitive power loss between ground and high voltage multiplier.

DEFINITIONS

Figure 1:
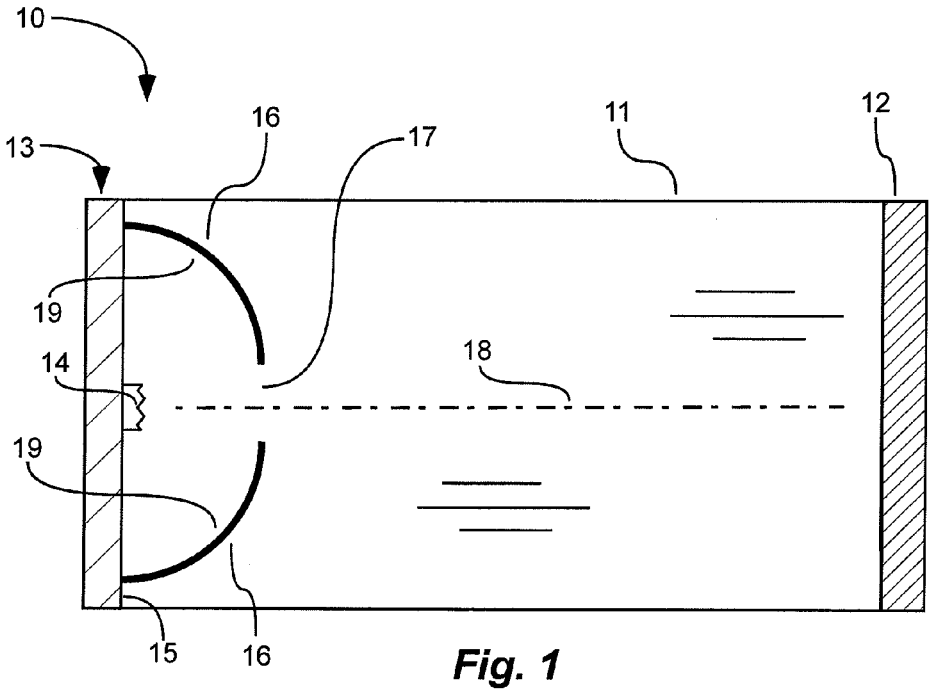
FIG. 1 schematic cross-sectional side view of an x-ray tube with a reflector attached to the x-ray tube cathode in accordance with an embodiment of the present invention.

As used herein, the term "about" is used to provide flexibility to a numerical range endpoint by providing that a given value may be "a little above" or "a little below" the endpoint.

As used herein, the term "bias voltage" or "bias high voltage" means a DC voltage that may be applied to an AC signal.

As used herein, the term "cylinder" is used for part of an x-ray tube that is capped at each end by an anode and a cathode. Although such portions of x-ray tubes typically have a pipe-like shape, with circular ends, such shape is not required by this invention and thus the term cylinder should be interpreted broadly to include other shapes.

As used herein, the term "high voltage" or "higher voltage" refer to the DC absolute value of the voltage. For example, negative 1 kV and positive 1 kV would both be considered to be "high voltage" relative to positive or negative 1 V. As another example, negative 40 kV would be considered to be "higher voltage" than 0 V.

As used herein, the term "low voltage" or "lower voltage" refer to the DC absolute value of the voltage. For example, negative 1 V and positive 1 V would both be considered to be "low voltage" relative to positive or negative 1 kV. As another example, positive 1 V would be considered to be "lower voltage" than 40 kV.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Infrared Focusing for Power Reduction of X-Ray Tube Electron Emitter

As illustrated in FIG. 1, an x-ray tube 10 is shown comprising an evacuated insulative cylinder 11 with an anode 12 disposed at one end and a cathode 13 disposed at an opposing end. The anode 12 includes a material configured to produce x-rays in response to impact of electrons. The cathode 13 includes a filament 14 disposed at an inward face 15 of the cathode 13. The filament 14 is configured to produce electrons accelerated towards the anode 12 in response to an electric field between the anode 12 and the cathode 13. An infrared heat reflector 16 is disposed inside the insulative cylinder 11 between the cathode 13 and the anode 12 and oriented to reflect a substantial portion of infrared heat radiating from the filament 14 back to the filament 14. The reflector 16 has a curved, concave shape 19 facing the cathode. The reflector 16 has an opening 17 aligned with an electron path 18 between the filament 14 and the anode 12 and the opening 17 is sized to allow a substantial amount of electrons to flow from the filament 14 to the anode 12.

The above embodiment can have many advantages including reduced power consumption. Reduced power consumption can be achieved by the reflector 16 reflecting infrared heat back to the filament 14, thus resulting in reduced heat loss from the filament 14. Lower power input can be achieved due to the reduced heat loss. Reduced power input can result in cost savings, and for battery powered x-ray sources, longer battery life. Improved power supply electronic stability may also be achieved by reducing heat transfer to the power supply electronics. Heat transfer to the power supply electronics can be reduced by reflecting some of the heat radiated from the filament 14 back to the filament 14 rather than allowing this radiated heat to escape the x-ray tube and heat surrounding electronics.

The curved, concave shape 19 of the reflector 16 can have various shapes of curvature. In one embodiment, the curved, concave shape 19 can include a portion of a spherical shape. In another embodiment, the curved, concave shape 19 can include a portion of an elliptical shape. In another embodiment, the curved, concave shape 19 can include a portion of a parabolic shape. In another embodiment, the curved, concave shape 19 can include a portion of a hyperbolic shape. The curved shape 19 may be selected based on which shape: (1) is most readily available, (2) fits best into an x-ray tube design, (3) better reflects heat back to the filament, and/or is easier to manufacture. A portion of a spherical shape may be preferred for improved heat reflection back to the filament 14.

Improved performance can be achieved by situating the filament in a location in which optimal heat transfer back to the filament 14 may be achieved. It is believed that optimal heat transfer may be achieved if the filament 14 is disposed at or near a focal point of the reflector. For example, a focal point of a sphere is one half of a radius of the sphere, thus optimal heat transfer may be achieved with the filament 14 disposed at a distance of one half of the radius from the reflector 16.

Improved heat transfer back to the filament 14 can be achieved by use of a surface on the reflector that optimizes reflection of infrared radiation. For example, a metallic surface, especially a smooth, specular surface, can aid in optimizing reflection of infrared radiation back to the filament 14. The entire reflector 16 can be metallic or the reflector can include a metallic surface on a side 19 facing the filament 14. In one embodiment, the reflector can have a reflectivity on a side 19 facing the filament 14 of greater than about 0.75 for infrared wavelengths of 1 to 3 μm.

In one embodiment, an area of the opening 17 can be less than 10% of a surface area of the reflector 16 on a side of the reflector facing the filament. In another embodiment, an area of the opening 17 can be at least 10% of a surface area of the reflector 16 on a side of the reflector facing the filament. In another embodiment, an area of the opening 17 can be at least 25% of a surface area of the reflector 16 on a side of the reflector facing the filament. In another embodiment, an area of the opening 17 can be at least 50% of a surface area of the reflector 16 on a side of the reflector facing the filament. In another embodiment, an area of the opening 17 can be at least as great a surface area of the reflector on a side of the reflector facing the filament.

Figure 2:
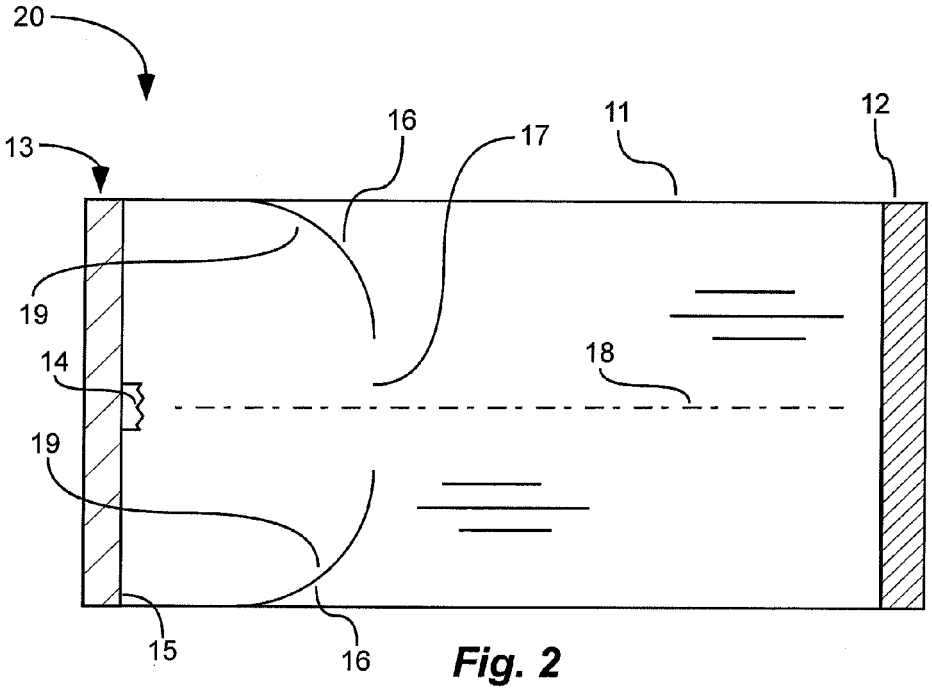
FIG. 2 schematic cross-sectional side view of an x-ray tube with a reflector attached to the x-ray tube cylinder in accordance with an embodiment of the present invention.

As shown in FIG. 1, the reflector 16 can be attached to the cathode 13. As shown in FIG. 2, the reflector 16 can be attached to the cylinder 11.

Figure 3:
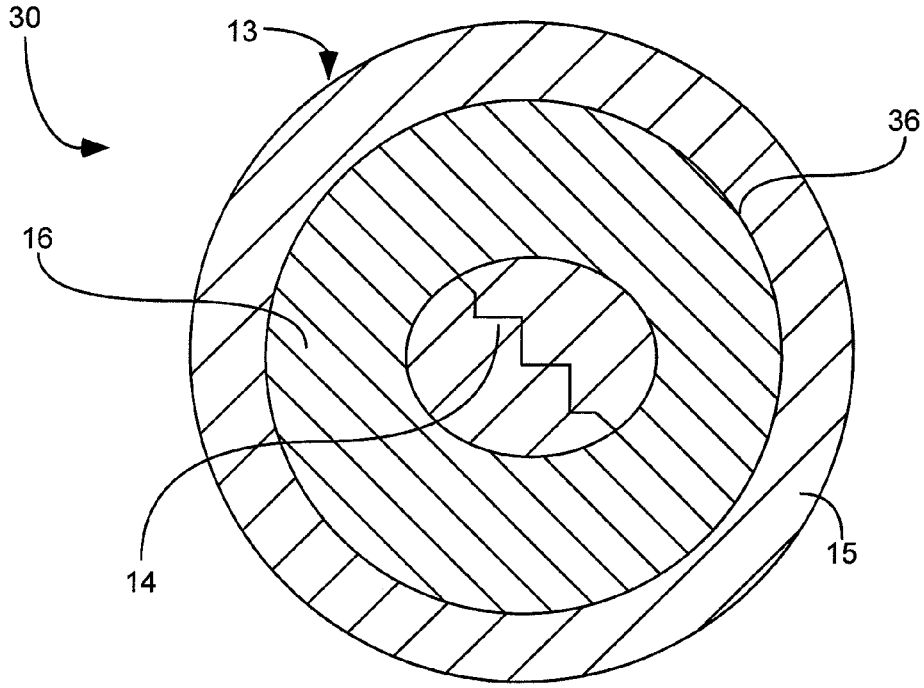
FIG. 3 is a schematic top view of an x-ray tube cathode, filament, and reflector in accordance with an embodiment of the present invention.

As shown in FIG. 3, the reflector 16 can have a substantially circular shape 36 oriented to the inward face 15 of the cathode 13.

The reflector 16 can be manufactured by machining. The reflector can be attached to the cathode 13 and/or the cylinder 11 by an adhesive or by welding.

Amplitude Modulation of X-Ray Tube Filament Power

Figure 4:
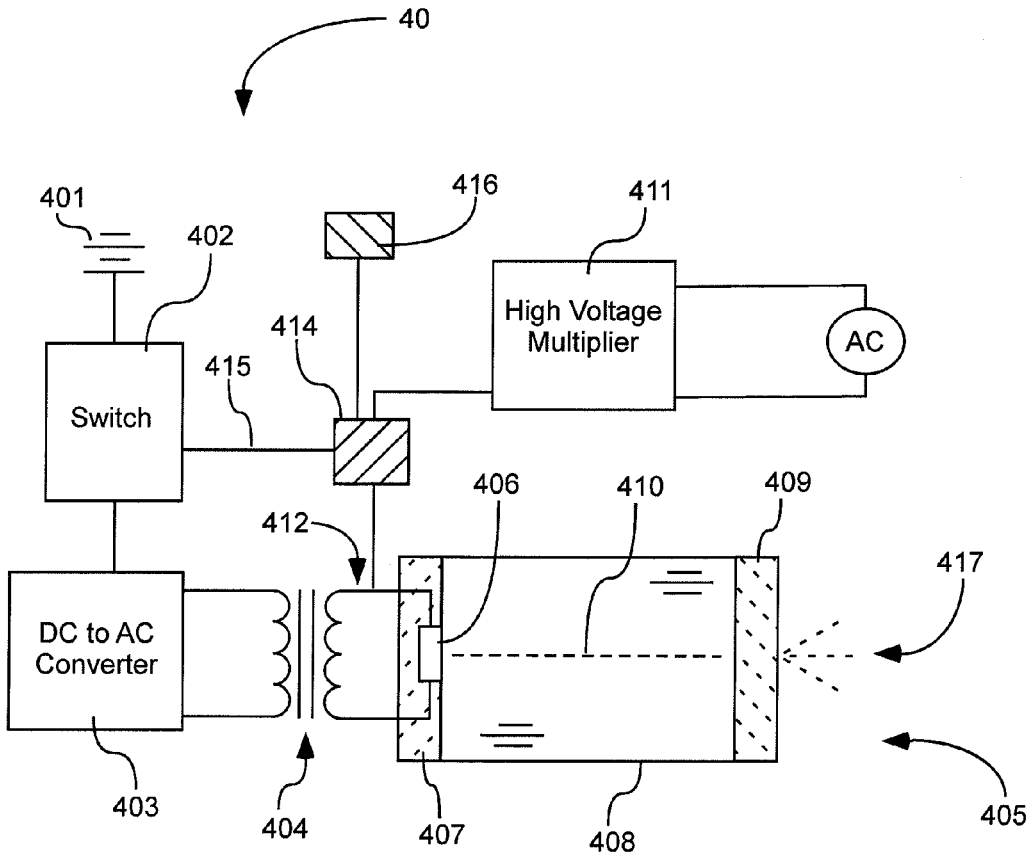
FIG. 4 is an electrical circuit schematic showing a switch used for changing the amount of alternating current flowing through an x-ray tube filament, in accordance with an embodiment of the present invention.

As illustrated in FIG. 4, an alternating current source for an x-ray tube filament 40 is shown comprising a voltage source 401 providing direct current to a direct current to alternating current (DC to AC) converter 403 through a switch 402. The switch 402 can be an analog switch.

X-ray tube 405 is also shown in FIG. 4 comprising a filament 406, cathode 407, evacuated cylinder 408, and anode 409. The DC to AC converter 403 can provide alternating current to the x-ray tube filament 406. A transformer 404 may separate the DC to AC converter 403, at low DC bias voltage, from the filament 406, at high DC bias voltage, thus an AC signal can be passed from a low DC bias to a high DC bias. Alternatively, capacitors (not shown), may be sued for isolating the DC to AC converter 403, at low DC bias voltage, from the filament 406, at high DC bias voltage. Due to heat caused by alternating current through the filament 406, and due to a large DC voltage differential between the filament 406 and the anode 409, an electron beam 410 may be generated from the filament 406 to the anode 409. Electrons from this electron beam 410 impinge upon the anode, thus producing x-rays 417. The large DC voltage differential between the filament 406 and the anode 409 can be produced by a high voltage multiplier 411.

There can be a need to change the flux of x-rays 417 exiting the x-ray tube 405. Adjusting alternating current flow through the filament 406 can change the filament temperature which results in a change in electron beam 410 flux and thus a change in the x-ray 417 flux.

Switch 402 can be used to adjust alternating current flow through the filament 406. The switch 402 can have two positions. Electrical current flow through the switch when the switch is in the first switch position can be substantially higher than electrical current flow through the switch when the switch is in the second switch position. In a preferred embodiment, no electrical current is allowed to flow through the switch when the switch is in the second position. As used herein, the phrase "no electrical current is allowed to flow through the switch" means that no electrical current, or only a very negligible amount of current, is allowed to flow through the switch. Due to imperfections in switches, switches can have a minimal amount of leakage current even when the switch is positioned to prevent current flow.

In one embodiment, electrical current flow through the switch when the switch is in the first switch position is at least 3 times more than electrical current flow through the switch when the switch is in the second switch position. In another embodiment, electrical current flow through the switch when the switch is in the first switch position is at least 5 times more than electrical current flow through the switch when the switch is in the second switch position. In another embodiment, electrical current flow through the switch when the switch is in the first switch position is at least 10 times more than electrical current flow through the switch when the switch is in the second switch position. In another embodiment, electrical current flow through the switch when the switch is in the first switch position is at least 100 times more than electrical current flow through the switch when the switch is in the second switch position. In another embodiment, electrical current flow through the switch when the switch is in the first switch position is at least 1000 times more than electrical current flow through the switch when the switch is in the second switch position.

Thus, when a lower x-ray 417 flux is desired, the switch 402 can turn to the second switch position, then back the first switch position again. The switch can repeatedly go back and forth between the first switch position and the second switch position. The switch can either be left in the second switch position for a longer time, or turned to the second switch position more frequently, if lower x-ray flux 417 is desired. Alternatively, the switch can either be left in the second switch position for a shorter time, or turned to the second switch position less frequently, if higher x-ray flux 417 is desired. This switching from one switch position to the other can occur rapidly, such as for example, from about 3 Hz to 50 kHz or more.

A setpoint for desired x-ray 417 flux can be input 416, such as by an operator of the x-ray source. This input 416 can give a signal to a feedback module 414. The feedback module 414 can receive a signal of x-ray 417 flux, compare this x-ray 417 flux to the input 416 setpoint and send a signal 415 to the switch 402 to change the amount of time the switch is in one of the positions compared to the other position in order to cause the input x-ray 417 flux to match the setpoint. Note that when the switch is in the second position, no or less electrical current passes through the switch 402, and thus no or less DC voltage reaches the DC to AC converter 403 and no or less current flows through the filament 406. With the switch in the second position for an increased proportion of time, the filament 406 will have a lower temperature with resulting lower electron beam 410 flux and lower x-ray 417 flux.

Electron beam 410 flux and thus x-ray 417 flux can be approximated by an amount of electrical current flowing from the high voltage multiplier 411 to the filament circuit 412. The amount of electrical current flowing from the high voltage multiplier 411 through feedback module 414 to the filament circuit 412 can be measured, such as by measuring voltage drop across a resistor, and this amount of electrical current can be input to the feedback module 414.

For example, for a desired reduction in x-ray 417 flux, input 416 can be reduced. Feedback module 414 can detect that x-ray 417 flux is too high due to too large of a current to the filament circuit 412 as recognized in the feedback module 414. A signal 415 can be sent to the switch 402 to increase the proportion of time that the switch 402 is in the second position, thus decreasing the total amperage through the filament. Note that rather than decreasing electrical current through the filament 406 by a higher voltage drop across a linear regulator 92, thus producing heat and wasting energy, the electrical current through the filament 406 is decreased by turning power to the filament 406 off for a larger proportion of time, thus avoiding the power loss and heat generated as with a linear regulator 92.

Input 416 can include a first setpoint and a second setpoint. The feedback module 414 can be configured to set the switch 402 to the first switch position (1) for more time when the electron beam current level is below the first set point or (2) for less time when the electron beam current level is above the second set point. The first and second setpoints can be different, or the first setpoint can equal the second setpoint.

The DC to AC converter 403 can be configured to provide alternating current to the x-ray tube filament 406 at a frequency between about 0.5 MHz to about 200 MHz. For example, in one embodiment, the frequency is about 1 MHz to about 4 MHz.

One embodiment of the present invention includes a method for providing alternating current to the x-ray tube filament 406. The method comprises providing alternating current to the filament 406 from a voltage source 401 through a switch 402 and a DC to AC converter 403. The filament 406 generates an electron beam 410, the electron beam 410 having an electron beam current level. A feedback signal is sent to the switch 402 based on the electron beam current level. The voltage source 401 is connected to the DC to AC converter 403 through the switch 402 for (1) more time when electron beam current level is less than a first set point and (2) less time when electron beam current level is greater than a second set point. The first and second setpoints can be the same (a single set point) or can be different values. The switch can be an analog switch.

In the various embodiments described herein, the DC to AC converter can comprise an oscillator and a chopper.

Neutral Grounding of High Voltage Multiplier

Figure 5:
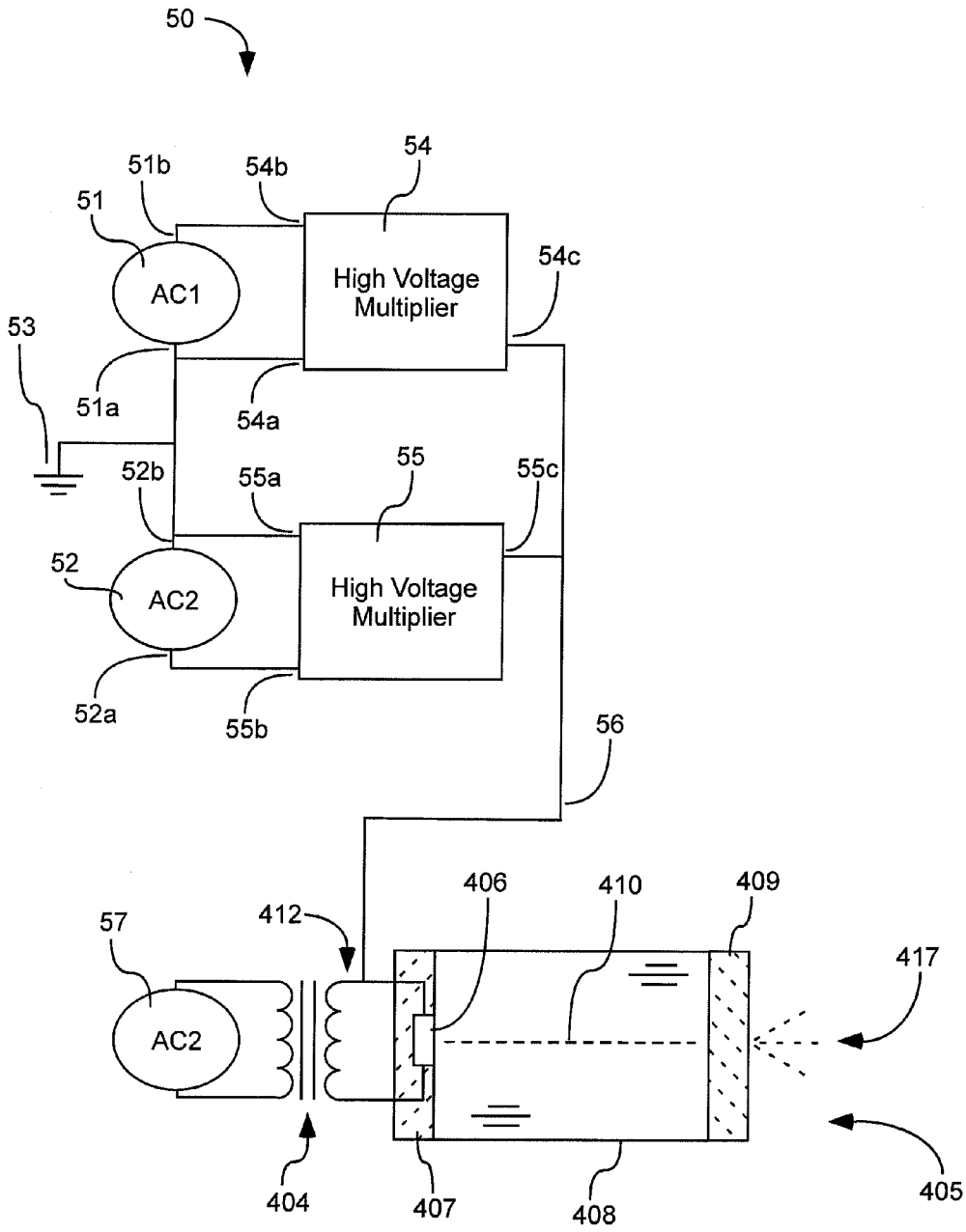
FIG. 5 is an electrical circuit schematic showing a power supply for an x-ray tube filament including two high voltage multipliers connected in a neutral grounding configuration, in accordance with an embodiment of the present invention.

As illustrated in FIG. 5, a neutral grounded, direct current (DC) high voltage, power supply 50 is shown comprising a first alternating current (AC) source 51 having a first connection 51*a* and a second connection 51*b*; a second AC source 52 having a first connection 52*a* and a second connection 52*b*; a first high voltage multiplier 54 having an AC connection 54*b*, a ground connection 54*a*, and an output connection 54*c*; and a second high voltage multiplier 55 having an AC connection 55*b*, a ground connection 55*a*, and an output connection 55*c*.

The first connection 51*a* of the first AC source 51 is electrically connected to the second connection 52*b* of the second AC source 52, an electrical ground 53, the first high voltage multiplier ground connection, and the second high voltage multiplier ground connection. The second connection of the first AC source is electrically connected to the first high voltage multiplier AC connection. The first connection of the second AC source is electrically connected to the second high voltage multiplier AC connection. The first high voltage multiplier output connection is electrically connected to the second high voltage multiplier output connection.

With this design, the amount of current flowing to ground can be reduced, thus minimizing capacitive power loss between ground and high voltage multiplier. This is accomplished by power flow between the two high voltage multipliers. In a preferred embodiment, no electrical current, or negligible electrical current, flows to ground, but rather all, or nearly all, of the alternating current flows between the two high voltage multipliers. With no or negligible electrical current flowing to ground, capacitive power loss between the high voltage multipliers and ground can be eliminated or significantly reduced. The two AC sources may be configured to be operated in phase with each other in order to avoid electrical current flow to ground. In case it is not practical for the AC sources to be in phase, then they may be operated close to being in phase, such as for example, less than 30 degrees out of phase, less than 60 degrees out of phase, or less than or equal to 90 degrees out of phase.

The high voltage multipliers can generate a very high DC voltage differential between the ground and the high voltage multiplier output connections. For example, this DC voltage differential can be at least 10 kilovolts, at least 40 kilovolts, or at least 60 kilovolts.

In one embodiment, the high voltage power supplies described herein can be used to supply high DC voltage to an x-ray tube 405 filament 406 as shown in FIG. 5. The x-ray tube comprises an evacuated insulative cylinder 408, an anode 409 disposed at one end of the insulative cylinder 408 including a material configured to produce x-rays 417 in response to impact of electrons 410, and a cathode 407 disposed at an opposing end of the insulative cylinder 408 from the anode 409. The power supply 50 or 60 can provide at least 10 kilovolts of DC voltage between the cathode 407 and the anode 409. The filament 406, located at the cathode 407 can be heated by alternating current provided by an alternating current source 57. The alternating current source 57 can be electrically isolated from the high DC voltage of the filament by a transformer 404 or capacitors (not shown). Electrons 410 can be accelerated from the cathode 407 towards the anode in response to an electric field between the cathode 407 and the anode 409 and due to heat of the filament from the alternating current.

Figure 6:
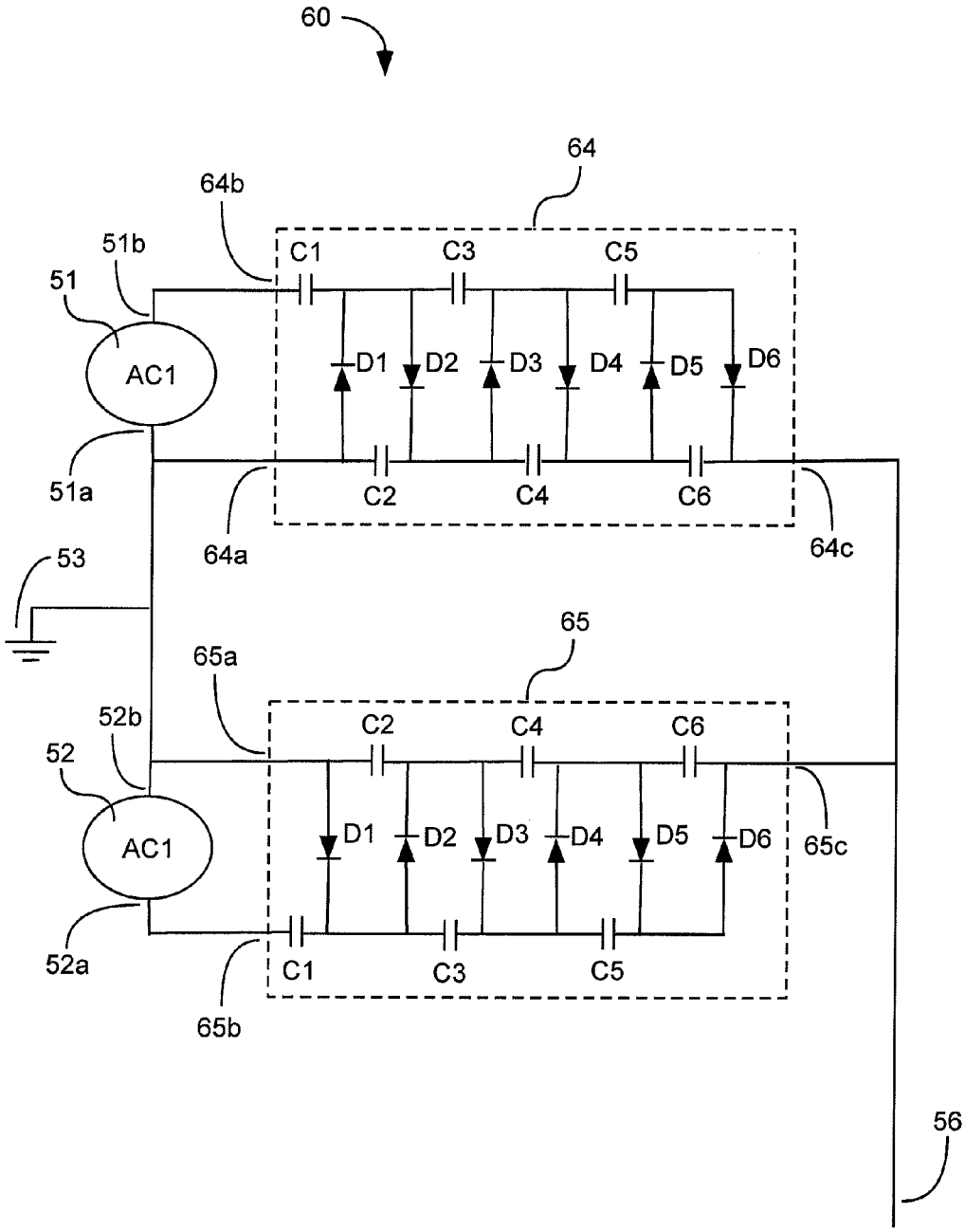
FIG. 6 is an electrical circuit schematic showing a high voltage bias power supply including two Cockcroft-Walton high voltage multipliers connected in a neutral grounding configuration, in accordance with an embodiment of the present invention.
Figure 7:
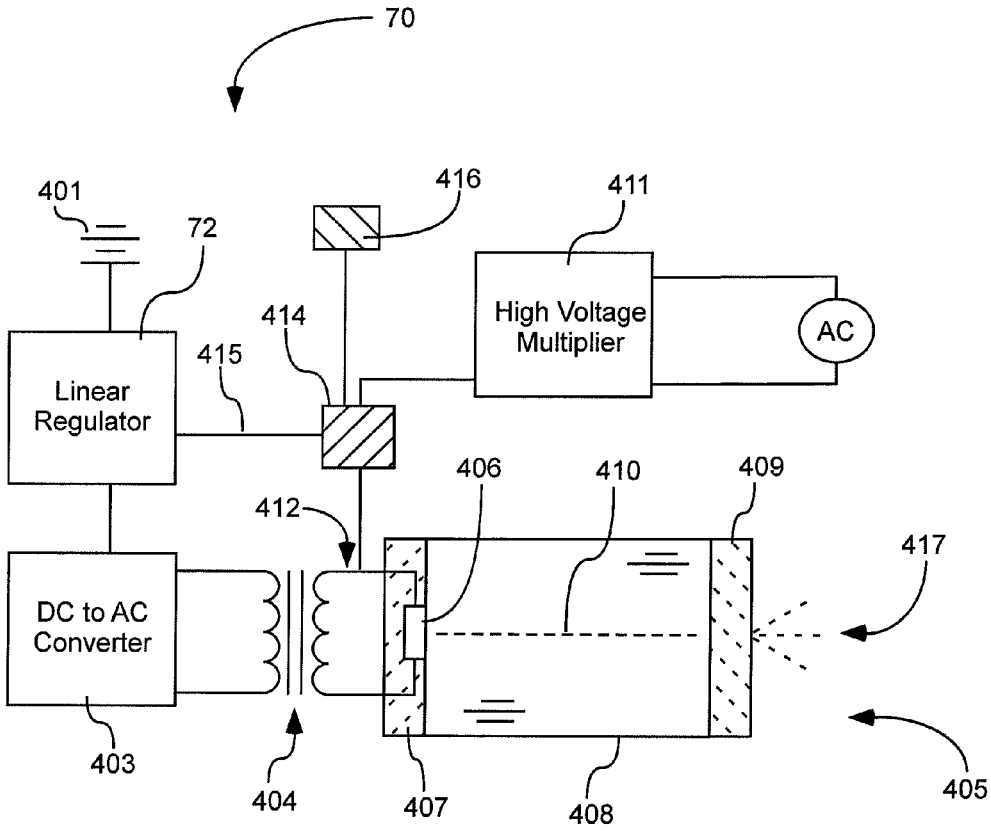
Fig. 7 prior art
FIG. 7 is an electrical circuit schematic showing a linear regulator used for changing the amount of alternating current flowing through an x-ray tube filament, in accordance with prior art.
Figure 8:
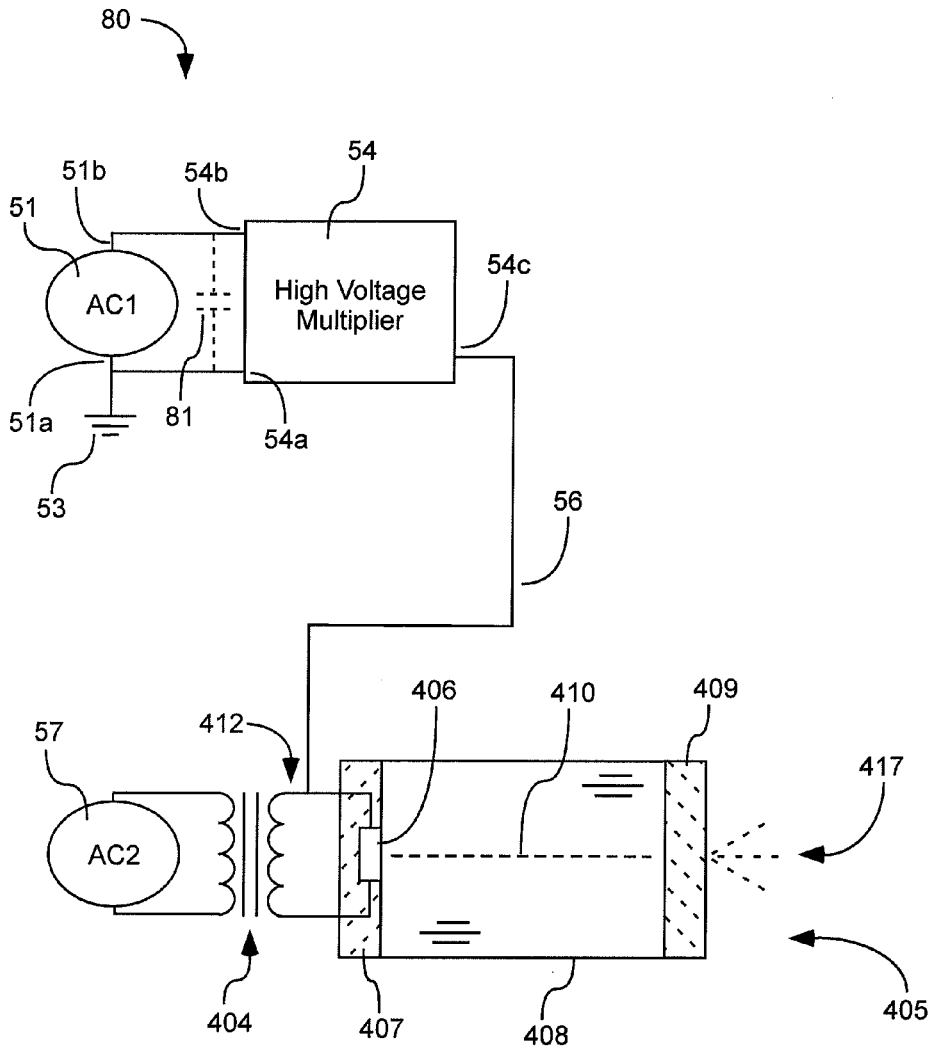
Fig. 8 prior art
FIG. 8 is an electrical circuit schematic showing a power supply for an x-ray tube filament in accordance with prior art.

As shown in FIG. 6, the high voltage multipliers 64 and 65 of the power supply 60 can be Cockcroft Walton multipliers. The Cockcroft Walton multipliers 64 and 65 can comprise capacitors C1-C6 and diodes D1-D6. Note that Cockcroft Walton multipliers can include more or less stages with more or less diodes and more or less capacitors than shown in FIG. 6. The direction of the diodes may be reversed depending on the desired polarity of output voltage. In FIG. 6, the first AC source 51 output connection 51*b* is connected to the first Cockcroft Walton multiplier 64 AC connection 64*b*, which is also the location of this multiplier first capacitor C1. The second AC source 52 input connection 52*a* is connected to the second Cockcroft Walton multiplier 65 AC connection 65*b*, which is also the location of this multiplier's first capacitor C1. The first AC source 51 input connection 51*a*, the second AC source 52 output connection 52*b*, the Cockcroft Walton multiplier ground connections 64*a* and 65*a* are all connected to electrical ground. The Cockcroft Walton multiplier output connections 64*c* and 65*c* are connected and can supply high voltage DC power 56 to a load.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An x-ray tube comprising:

a) an evacuated insulative cylinder;

b) an anode disposed at one end of the insulative cylinder including a material configured to produce x-rays in response to impact of electrons;

c) a cathode disposed at an opposing end of the insulative cylinder from the anode, the cathode including a filament disposed at an inward face of the cathode, the filament configured to produce electrons accelerated towards the anode in response to an electric field between the anode and the cathode;

d) an infrared heat reflector disposed inside the insulative cylinder between the cathode and the anode, and oriented to reflect a substantial portion of infrared heat radiating from the filament back to the filament;

e) the reflector having a curved, concave shape facing the cathode;

f) an opening in the reflector aligned with an electron path between the filament and the anode; and g) the opening sized to allow a substantial amount of electrons to flow from the filament to the anode.

2. The device of claim 1, wherein the curved, concave shape includes a portion of a spherical shape.

3. The device of claim 1, wherein an area of the opening is at least 10% of a surface area of the reflector on a side of the reflector facing the filament.

4. The device of claim 1, wherein an area of the opening is at least 25% of a surface area of the reflector on a side of the reflector facing the filament.

5. The device of claim 1, wherein the reflector has a metallic surface on a side facing the filament.

6. The device of claim 1, wherein the reflector has a reflectivity on a side facing the filament of greater than about 0.75 for infrared wavelengths of 1 to 3 μm.

7. The device of claim 1, wherein the filament is disposed at a focal point of the reflector.

8. An alternating current source for an x-ray tube filament comprising:

a) a voltage source;

b) a switch that is electrically coupled to the voltage source;

c) the switch having a first switch position and a second switch position;

d) electrical current flow through the switch when the switch is in the first switch position is at least 3 times more than the electrical current flow through the switch when the switch is in the second switch position;

d) a direct current to alternating current (DC to AC) converter:

i) configured to provide alternating current to the x-ray tube filament;

ii) electrically coupled to the voltage source through the switch; and iii) provides more alternating current to the x-ray tube filament when the switch is in the first position;

f) the x-ray tube filament configured to produce an electron beam having an electron beam current level;

g) a feedback module receiving input regarding the electron beam current level; and h) the feedback module directing the switch to the first switch position for more or less time based on the electron beam current level.

9. The alternating current source of claim 8 wherein:

a) the feedback module is configured to set the switch to the first switch position for more time when the electron beam current level is below a first set point; and b) the feedback module is configured to set the switch to the first switch position for less time when the electron beam current level is above a second set point.

10. The alternating current source of claim 8 wherein the DC to AC converter provides alternating current to the x-ray tube filament through a transformer.

11. The alternating current source of claim 8 wherein the DC to AC converter is configured to provide the alternating current to the x-ray tube filament at a frequency between about 0.5 MHz to about 200 MHz.

12. The alternating current source of claim 8 wherein the switch is an analog switch.

13. The alternating current source of claim 8 wherein electrical current flow through the switch when the switch is in the first switch position is at least 100 times more than the electrical current flow through the switch when the switch is in the second switch position.

14. The alternating current source of claim 8 wherein no electrical current is allowed to flow through the switch when the switch is in the second switch position.

15. A neutral grounded, direct current (DC) high voltage, power supply comprising:

a) a first alternating current (AC) source having a first connection and a second connection;

b) a second AC source having a first connection and a second connection;

c) a first high voltage multiplier having:

i) an AC connection;

ii) a ground connection;

iii) an output connection;

d) a second high voltage multiplier having:

i) an AC connection;

ii) a ground connection;

iii) an output connection;

e) the first connection of the first AC source, the second connection of the second AC source, the first high voltage multiplier ground connection, and the second high voltage multiplier ground connection all electrically connected to an electrical ground;

f) the second connection of the first AC source electrically connected to the first high voltage multiplier AC connection;

g) the first connection of the second AC source electrically connected to the second high voltage multiplier AC connection; and h) the first high voltage multiplier output connection electrically connected to the second high voltage multiplier output connection.

16. The power supply of claim 15 wherein a DC voltage differential between the ground and the high voltage multiplier output connections is at least 10 kilovolts.

17. The power supply of claim 15 further comprising an x-ray tube including:

a) an evacuated insulative cylinder;

b) an anode disposed at one end of the insulative cylinder including a material configured to produce x-rays in response to impact of electrons; and c) a cathode disposed at an opposing end of the insulative cylinder from the anode;

d) the power supply providing at least 10 kilovolts of DC voltage between the cathode and the anode; and e) electrons accelerated from the cathode towards the anode in response to an electric field between the cathode and the anode, the electric field generated by the at least 10 kilovolts of DC voltage between the cathode and the anode.

18. The power supply of claim 15 wherein the high voltage multipliers are Cockcroft Walton multipliers.

19. The power supply of claim 15 wherein the first AC source is configured to be operated in phase with the second AC source.

20. The power supply of claim 15 wherein a phase difference between the first AC source and the second AC source is less than or equal to ninety degrees.

* * * * *